US007901329B2

(12) United States Patent
Tsai

(10) Patent No.: US 7,901,329 B2
(45) Date of Patent: Mar. 8, 2011

(54) SWINGING GYMNASTIC MACHINE

(75) Inventor: Jao-Hsing Tsai, Hsinchu (TW)

(73) Assignee: Cheng-Kang Chu, Hsinchu (TW)

( * ) Notice: Subject to any disclaimer, the term of this patent is extended or adjusted under 35 U.S.C. 154(b) by 0 days.

(21) Appl. No.: 12/670,169

(22) PCT Filed: Apr. 4, 2007

(86) PCT No.: PCT/CN2007/001094

§ 371 (c)(1),
(2), (4) Date: Jan. 22, 2010

(87) PCT Pub. No.: WO2008/122143

PCT Pub. Date: Oct. 16, 2008

(65) Prior Publication Data

US 2010/0210424 A1 Aug. 19, 2010

(51) Int. Cl.
*A63B 22/00* (2006.01)

(52) U.S. Cl. ..... 482/51; 482/115; 482/147

(58) Field of Classification Search ..... 482/51–53, 482/62, 70–71, 92, 114, 115, 118, 142, 146–148
See application file for complete search history.

(56) References Cited

U.S. PATENT DOCUMENTS

| | | | | |
|---|---|---|---|---|
| 6,149,552 | A | 11/2000 | Chen | |
| 6,309,326 | B1 * | 10/2001 | Huang | 482/57 |
| 7,041,037 | B2 * | 5/2006 | Huang | 482/53 |
| D567,312 | S * | 4/2008 | Tsai | D21/688 |
| D622,334 | S * | 8/2010 | Splane | D21/689 |
| 2006/0019801 | A1 * | 1/2006 | Zeng | 482/52 |
| 2006/0183604 | A1 * | 8/2006 | Chae | 482/51 |
| 2006/0229166 | A1 * | 10/2006 | Fan | 482/53 |
| 2007/0142182 | A1 * | 6/2007 | Yang et al. | 482/52 |
| 2008/0207415 | A1 * | 8/2008 | Tsai | 482/147 |
| 2010/0062913 | A1 * | 3/2010 | Splane | 482/96 |

FOREIGN PATENT DOCUMENTS

| | | | |
|---|---|---|---|
| CN | 2187702 | Y | 1/1995 |
| CN | 2790517 | Y | 6/2006 |
| DE | 202007002866 | U1 | 6/2007 |
| EP | 1810718 | A2 | 7/2007 |

* cited by examiner

*Primary Examiner* — Loan Thanh
*Assistant Examiner* — Daniel F Roland

(57) ABSTRACT

A swinging gymnastic machine includes a front swinging assembly, a rear swinging assembly, a handle assembly pivotally secured to the front swinging assembly, and a pedal assembly pivotally secured to the rear swinging assembly. Each of the front and rear swinging assemblies has a spring unit. The front and rear swinging assemblies are durable and are unsusceptible of deflection. The swinging gymnastic machine also has the benefit of reducing the occupied space when it is not in use as both a front leg and the handle assembly are adapted to be folded rearwardly. A person has to exert a great force to overcome the resistance of both the front and rear swinging assemblies through the arms and calves in order to effectively exercise.

8 Claims, 7 Drawing Sheets

SWINGING GYMNASTIC MACHINE

BACKGROUND OF THE INVENTION

1. Field of Invention

The invention relates to exercise equipment and more particularly to a swinging gymnastic machine with improved characteristics.

2. Description of Related Art

A conventional swinging gymnastic machine for legs and arms is disclosed in Taiwanese Utility Model Patent No. M300121. The swing type exercise machine comprises a base frame comprising an upper support;

a mounting block comprising a front upright rod fixedly secured to the support;

a swinging assembly comprising an arm having one end pivotally secured to the upright rod, and two pedals bifurcated from the other end of the arm;

and left and right handlebars pivotally secured to the upright rod.

However, since both the swinging assembly and the handlebars are pivotally secured to the upright rod, the whole weight of a person is borne upon the upright rod when both hands grasp the handlebars and both feet step on the pedals. This can adversely tilt the upright rod. As a result, both the swinging assembly and the handlebars cannot pivot normally.

Moreover, this kind of swing type exercise machine is bulky and is not collapsible. Hence, it may occupy a great space when it is disposed in an ordinary house or apartment. This in turn can increase the living space of a home.

Thus, as viewed from the above, it is desirable to provide a novel swinging gymnastic machine with practical and improved structure in order to overcome the inadequacies of the prior art.

SUMMARY OF THE INVENTION

It is therefore one object of the invention to provide a swinging gymnastic machine which is collapsible and overcomes the inadequacies of the conventional swinging gymnastic machine.

To achieve the above and other objects, the invention provides a swinging gymnastic machine comprising a base frame comprising a front leg and two rear legs;

a front swinging assembly comprising a front rod fixedly fastened to the front end of the base frame, a front collar rotatably put on the front rod with an upper portion of the front rod being exposed, a front frame element extending from the front collar out of the front end of the base frame, a front ring fitted in the upper end of the front collar with the front rod passing through, a ring-shaped front damping member disposed on the front ring and being adapted to co-rotate with both the front ring and the front collar, a ring-shaped front washer fixedly put on the top end of the front rod and seated upon the front damping member, a circular front cap comprising a concave bottom and a spring unit disposed in the concave bottom thereof, and a front threaded fastener driven through the circular front cap into the front collar;

a rear swinging assembly comprising a rear rod fixedly fastened to the rear end of the base frame, a rear collar rotatably put on the rear rod with an upper portion of the rear rod being exposed, a rear frame element extending from the rear collar toward the rear end of the base frame, a rear ring fitted in the upper end of the rear collar with the rear rod passing through, a ring-shaped rear damping member disposed on the rear ring and being adapted to co-rotate with both the rear ring and the rear collar, a ring-shaped rear washer fixedly put on the top end of the rear rod and seated upon the rear damping member, a circular rear cap comprising a concave bottom and a spring unit disposed in the concave bottom thereof, and a rear threaded fastener driven through the circular rear cap into the rear collar;

a handle assembly comprising a handlebar pivotally secured to a front portion of the front frame element;

and a pedal assembly slidably put on the rear frame element and comprising one pedal spaced from each side of the rear frame element respectively.

In one aspect of the invention, at the front end of the base frame further comprises a joint and a leg threaded fastener underneath for releasably pivotally securing the front leg to the joint such that the front leg is adapted to pivot toward the rear end of the base frame in response to loosening the leg threaded fastener. Furthermore, when the leg threaded fastener is taken off, the front leg can be folded at the direction of the back end of the base frame.

In another aspect of the invention the rear legs are splay with the rear end of the base frame disposed therebetween.

In still another aspect of the invention the front swinging assembly comprises:

a front rod with two flat opposites on the opening comprising a threaded hole on the top, and an annular lower flange disposed at a lower portion of the front rod is fixedly fastened to the top of the base frame with the lower flange urged against the top of the base frame;

a front collar comprising an axial channel with a major portion of the front rod loosely disposed therein so that the front collar rotates around the front rod, one front recesses disposed on each top and bottom end of the channel of the front collar respectively, wherein a diameter of each of the front recesses is greater than that of the channel of the front collar, and one ring-shaped front bearings disposed in each of the front recesses respectively to be rotatable around the front rod;

a front ring with the front rod passing through and seated upon the upper one of the front bearings, the front ring comprising a plurality of spaced top projections;

a front damping member having an outer diameter equal to that of the front collar and being disposed on the tops of both the front collar and the front ring, the front damping member comprising a central hole and a plurality of spaced bottom cavities with the projections of the front ring matingly inserted therein;

a front washer comprising a central hole having two flat edges, the front washer being put on the top of the front rod to be flush therewith and being seated upon the front damping member;

a circular front cap comprising a central hole aligned with the central hole of the front washer, the concave bottom, and a spring unit disposed in the concave bottom thereof to urge against the front washer therebelow;

and a front threaded fastener driven through the central hole of the circular front cap, the central hole of the front washer, and the central hole of the front damping member into the threaded hole of the front rod and pressed downward the front damping member.

In another aspect of the invention the rear swinging assembly comprises:

a rear rod having two flat opposites on the opening comprising a rear threaded hole on the top, and an annular lower flange wherein a lower portion of the rear rod is fixedly fastened to the top of the base frame with the lower flange urged against the top of the base frame;

a rear collar comprising an axial channel with a major portion of the rear rod loosely disposed therein so that the rear collar rotates around the rear rod, one rear recess on each top and bottom ends of the channel of the rear collar respectively wherein a diameter of each of the rear recesses is greater than that of the channel of the rear collar, and one ring-shaped rear bearings disposed in each of the rear recesses respectively to be rotatable around the rear rod;

a rear ring seated upon the upper one of the rear bearings with the rear rod passing through, the rear ring comprising a plurality of spaced top projections;

a rear damping member having an outer diameter equal to that of the rear collar and being disposed on the tops of both the rear collar and the rear ring, the rear damping member comprising a central hole and a plurality of spaced bottom cavities with the projections of the rear ring matingly inserted therein;

a rear washer comprising a central hole having two flat edges, the rear washer being put on the top of the rear rod to be flush therewith and being seated upon the rear damping member;

a circular rear cap comprising a central hole aligned with the central hole of the rear washer, the concave bottom, and a spring unit disposed in the concave bottom thereof to urge against the rear washer therebelow;

and a rear threaded fastener driven through the central hole of the circular rear cap, the central hole of the rear washer, and the central hole of the rear damping member into the rear threaded hole of the rear rod and pressed downward the rear damping member.

In still another aspect of the invention the handle assembly further comprises a C-shaped coupling having the bottom disposed on the front portion of the front frame element and being rotatably put on a central portion of the handlebar, and a handle threaded fastener driven through two opposite protrusions on the central portion of the C-shaped coupling to secure the handlebar and the C-shaped coupling together; and loosening of the handle threaded fastener unfastens the handlebar so as to pivot the handlebar toward the rear end of the base frame.

In still another aspect of the invention a rear frame element comprises a plurality of spaced top apertures; and the pedal assembly further comprises a frame member of inverted U-section slidably put on the rear frame element;

and a pedal threaded fastener driven through the frame member into one of the apertures.

In still another aspect of the invention the pedal assembly further comprises one arm extending outwardly from each side of the frame member respectively and each arm comprising a pedal. By utilizing the invention and comparing with the prior art, the invention has the following advantages: The handle assembly and the pedal assembly are secured to the front swinging assembly and the rear swinging assembly respectively. This arrangement enables these two different swinging assemblies to co-share the weight of an exercising person. Hence, the prior disadvantage of the whole weight of an exercising person borne upon the upright rod when both hands grasp the handlebars and both feet step on the pedals is eliminated. Both the handlebar and the front leg can be folded to reduce the occupied space of the swinging gymnastic machine when it is not in use. A user has to exert a great force to overcome strong resistance of both the front and rear swinging assemblies in order to effectively exercise the arms and the calves. Provision of spring units in each of the front and rear swinging assemblies enables a smooth exercise to be carried out. The advantages of the invention are summarized as follows:

1) The weight of an exercising person can be co-shared by the front and rear swinging assemblies. Hence, the swinging gymnastic machine of the invention is more durable and has a prolonged period of use time. Frequent part replacement and maintenance are substantially avoided. Both the rods are unsusceptible of deflection and a smooth exercise can be carried out as compared with the prior art.

2) Both the handlebar and the front leg can be folded to reduce the occupied space of the swinging gymnastic machine when it is not in use.

3) A user has to exert a great force to overcome strong resistance of both the front and rear swinging assemblies in order to effectively exercise the arms and the calves. Provision of spring units in each of the front and rear swinging assemblies enables a smooth operation to be carried out during exercise.

The above-mentioned and other objects, features and advantages of the invention will become apparent from the following detailed description taken with the accompanying drawings.

DETAILED DESCRIPTION OF THE INVENTION

Figure 1:
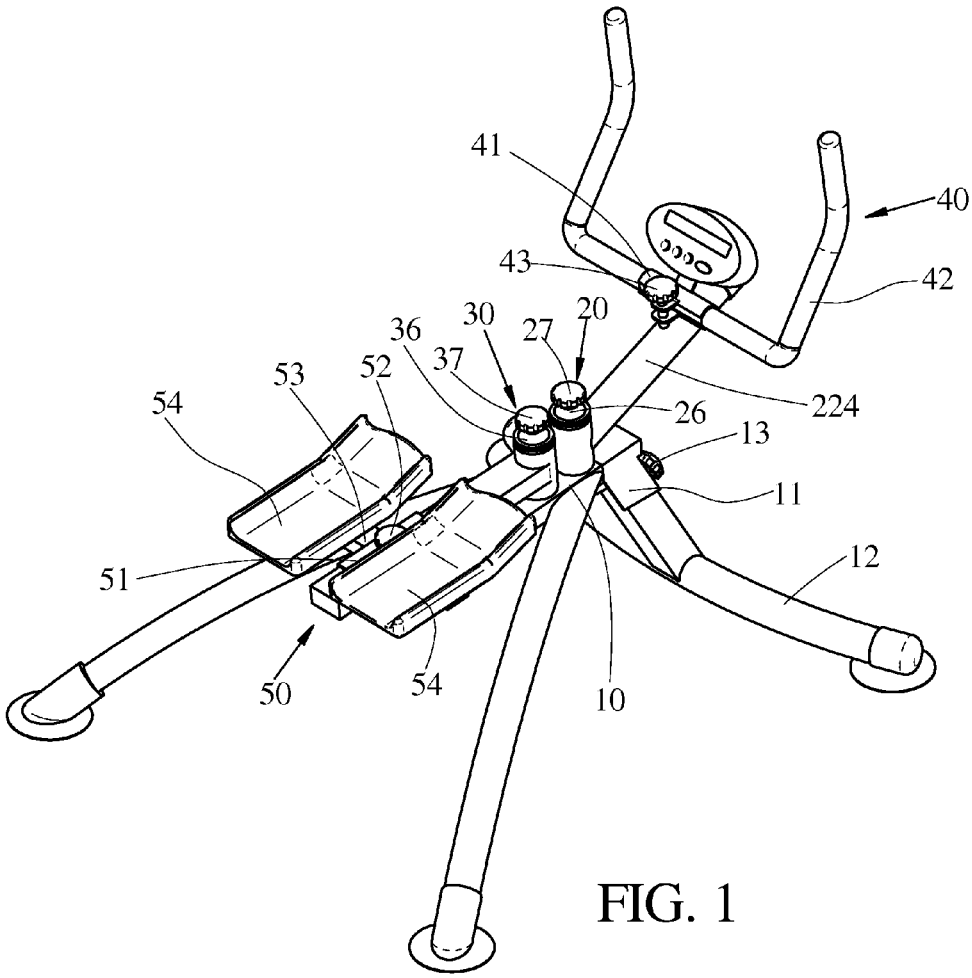
FIG. 1 is a perspective view of a swinging gymnastic machine according to the invention.

Referring to FIGS. 1 to 6, a swinging gymnastic machine in accordance with the invention comprises the following components as discussed in detail below.

A base frame 10 comprises a transverse front leg 12, two splay rear legs 14, a joint 11 fixedly secured to the rear legs 14, and a thumb screw 13 for releasably pivotally securing the front leg 12 to the joint 11.

Figure 3:
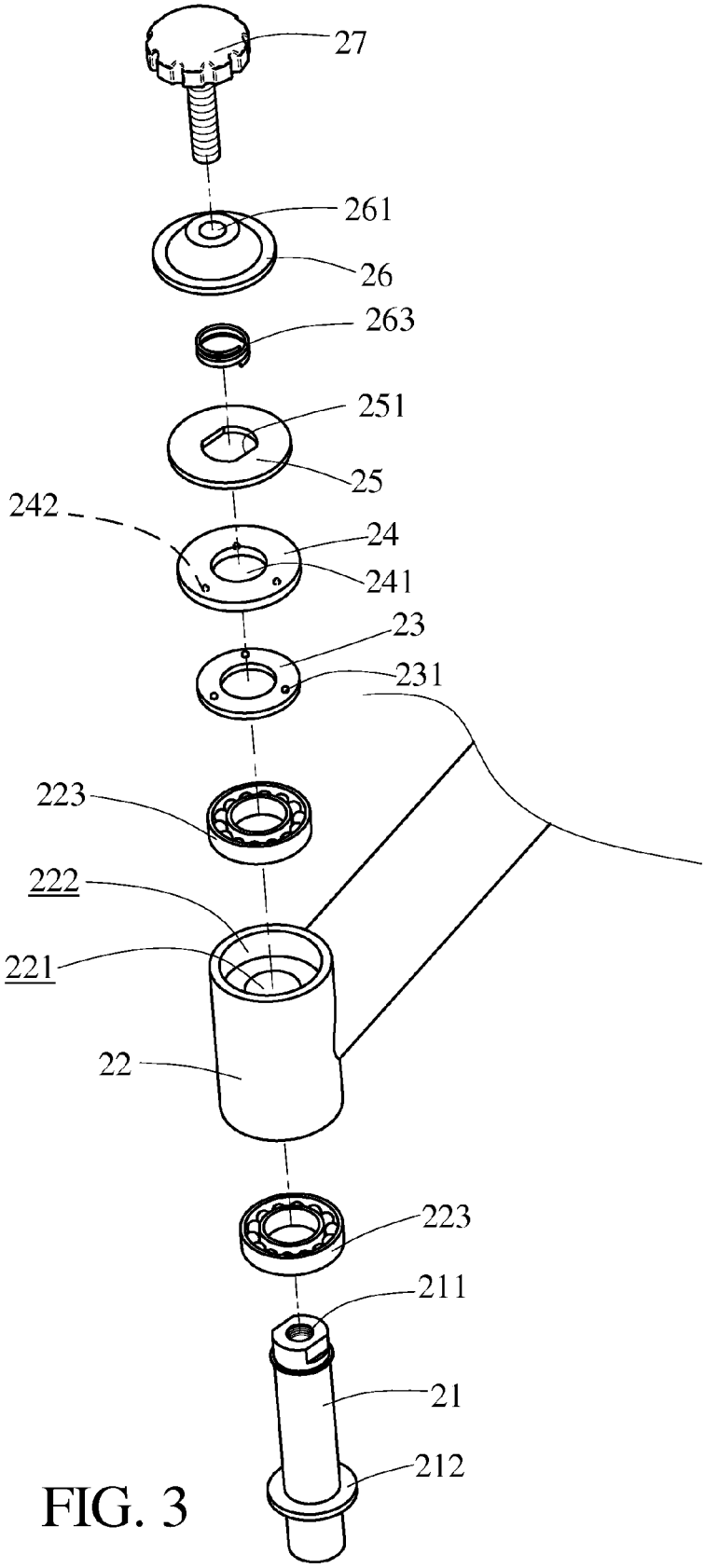
FIG. 3 is an exploded view of the front swinging assembly.
Figure 4:
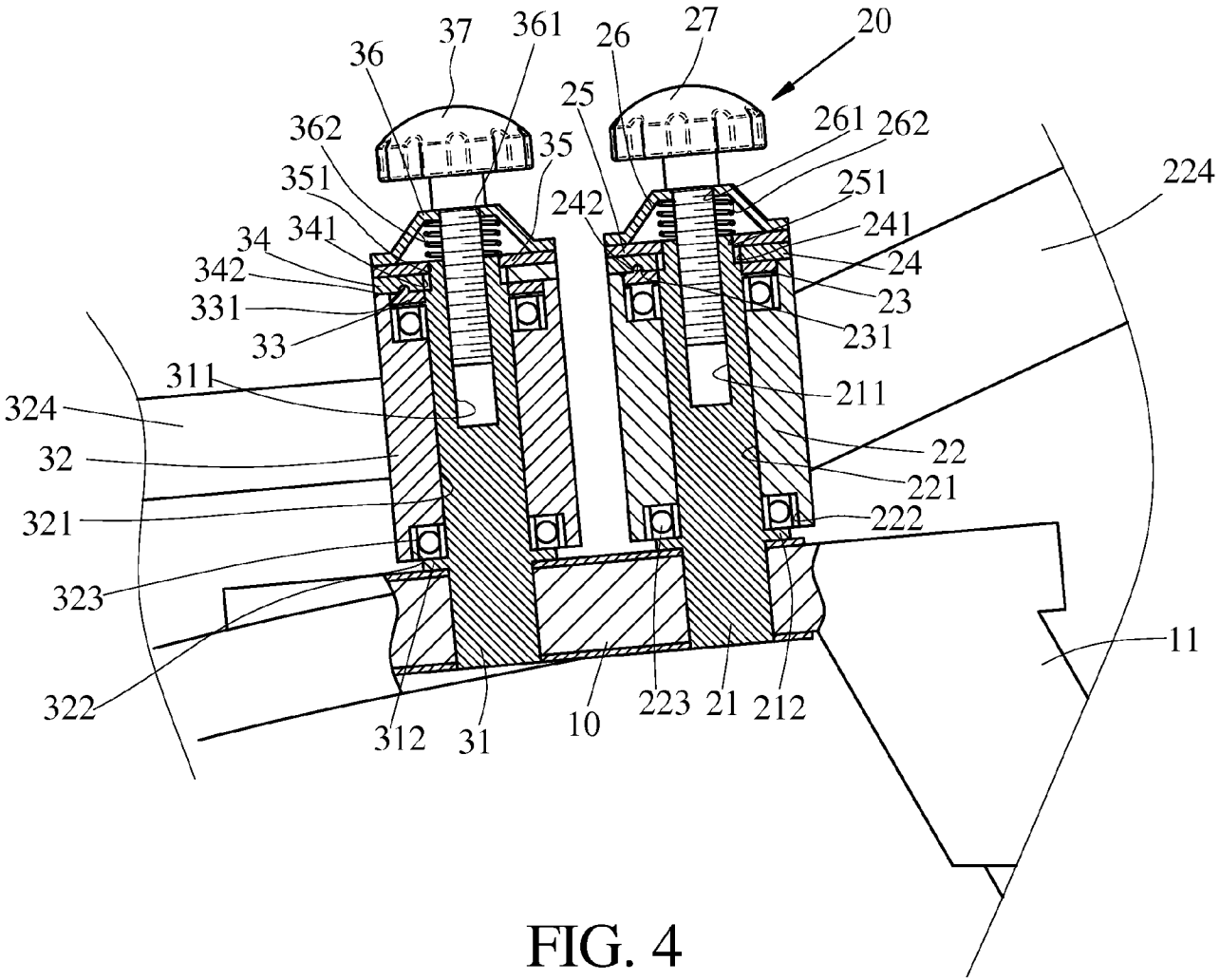
FIG. 4 is a longitudinal sectional view of the front and rear swinging assemblies.

As shown in FIGS. 3 and 4, a front swinging assembly 20 comprises the following components as discussed in detail below.

A front rod 21 having two flat opposites on the opening comprises a threaded hole 211 on the top, and an annular flange 212 proximate to the bottom. A lower portion of the rod 21 is fixedly fastened to the top of the base frame 10 with the flange 212 urged against the top of the base frame 10.

A collar 22 comprises an axial channel 221 with a major portion of the rod 21 loosely provided therein so that the collar 22 can rotate around the rod 21, one recess 222 on each end of the channel 221 respectively, wherein a diameter of the recesses 222 is greater than that of the channel 221, one ring-shaped bearing 223 provided in each of the recesses 222 respectively, and a front frame element 224 extending from the collar 22 out of the front end of the base frame 10.

A ring 23 is fitted in the upper bearing 223 with the rod 21 passing through. The ring 23 is flush with the top of the collar 22. The ring 23 has a plurality of equally spaced small projections 231 on the top.

A ring-shaped damping member 24 has an outer diameter equal to that of the collar 22 and is disposed on the tops of both the collar 22 and the ring 23. The damping member 24 comprises a central hole 241 and a plurality of equally spaced small cavities 242 on a bottom with the projections 231 matingly inserted therein.

A ring-shaped washer 25 comprises a central hole 251 having two flat edges. The washer 25 is put on the rod 21 to be flush therewith. Also, the washer 25 is seated upon the damping member 24.

A circular cap 26 comprises a central hole 261, a concave bottom 262, and a spring unit 263 provided in the concave bottom 262. The spring unit 263 is urged between the top of the rod 21 and top of the concave bottom 262. One end of the spring unit 263 is seated upon the washer 25.

A threaded fastener 27 is driven through the hole 261, the hole 251, and the hole 241 into the channel 221 and urged against the circular cap 26.

As shown in FIG. 4, a rear swinging assembly 30 comprises the following components as discussed in detail below.

A rod 31 having two flat opposites on the opening comprises a threaded hole 311 open to top, and an annular flange 312 proximate to the bottom. A lower portion of the rod 31 is fixedly fastened to the top of the base frame 10 with the flange 312 urged against the top of the base frame 10.

Figure 2:
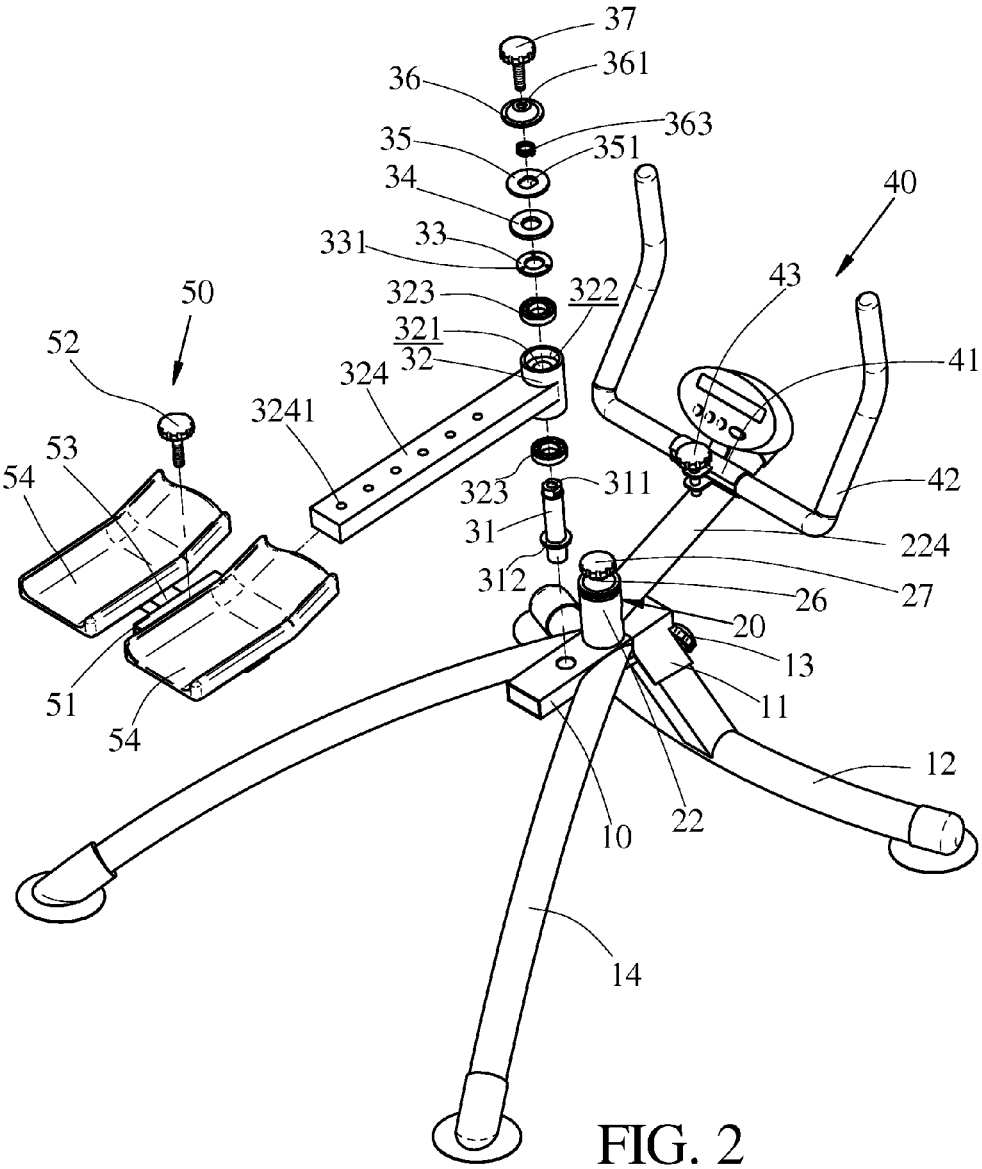
FIG. 2 is a perspective exploded view of the swinging gymnastic machine.

A collar 32 comprises an axial channel 321 with a major portion of the rod 31 loosely provided therein so that the collar 32 rotates around the rod 31, one recess 322 on each end of the channel 321 respectively, wherein a diameter of the recess 322 is greater than that of the channel 321, one ring-shaped bearing 323 provided in each of the recesses 322 respectively, and an elongated rear frame element 324 extending from the collar 32 toward the rear end of the base frame 10. The rear frame element 324 has a plurality of lengthwise equally spaced apertures 3241 on the top surface (as shown in FIGS. 2 and 3).

A ring 33 is fitted in the upper bearing 323 with the rod 31 passing through. The ring 33 is flush with the top of the collar 32. The ring 33 has a plurality of equally spaced small projections 331 on the top.

A ring-shaped damping member 34 has an outer diameter equal to that of the collar 32 and is disposed on the tops of both the collar 32 and the ring 33. The damping member 34 comprises a central hole 341 and a plurality of equally spaced small cavities 342 on the bottom with the projections 331 matingly inserted therein.

A ring-shaped washer 35 comprises a central hole 351 having two flat edges. The washer 35 is put on the rod 31 to be flush therewith. Also, the washer 35 is seated upon the damping member 34.

A circular cap 36 comprises a central hole 361 correspondently to the central hole 351, a concave bottom 362, and a spring unit 363 is provided in the concave bottom 362, one end of the spring unit 363 is urged against the ring-shaped washer 35.

A threaded fastener 37 is driven through the hole 361, the central hole 351, and the central hole 341 into the channel 311 and urged against the circular cap 36.

As shown in FIGS. 1 and 2, a handle assembly 40 comprises a handlebar 42, a C-shaped coupling 41 having the bottom provided on a portion of the front frame element 224 in proximity to the front end of the front frame element 224 and being rotatably put on a central portion of the handlebar 42, and a thumb screw 43 driven through two opposite protrusions on a central portion of the C-shaped coupling 41 to secure the handlebar 42 and the C-shaped coupling 41 together. It is understood that loosening of the thumb screw 43 can unfasten the handlebar 42 so that it is possible to pivot the handlebar 42 toward the rear end of the base frame 10.

As shown in FIG. 2, a pedal assembly 50 comprises a frame member 51 of an inverted U-section slidably put on the rear frame element 324, a thumb screw 52 driven through the frame member 51 into one of the apertures 3241 for adjusting the position of the frame member 51, one arm 53 extending outwardly from each side of the frame member 51 respectively, and each arm comprising a pedal.

Figure 5:
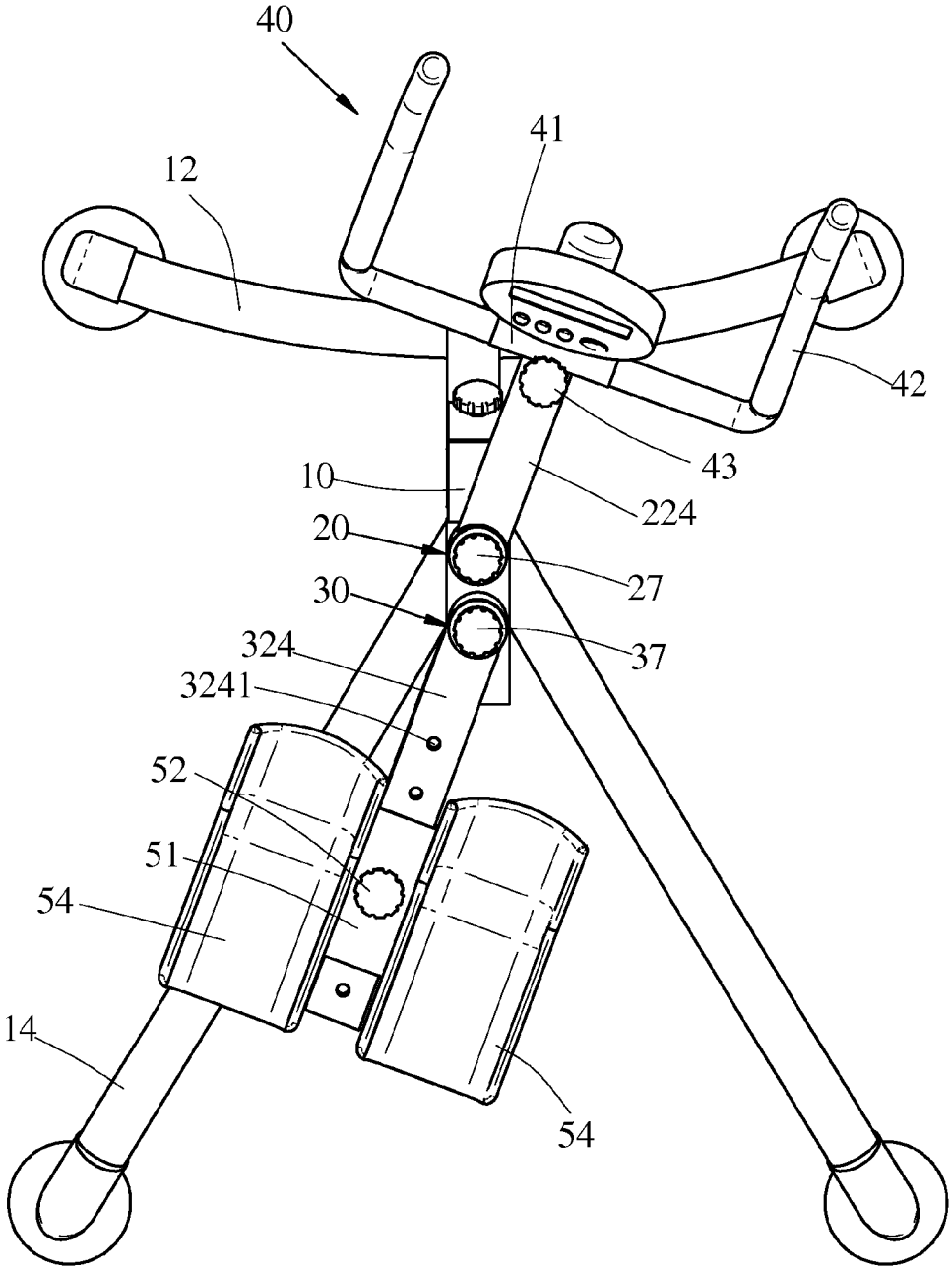
FIG. 5 is a top plan view of the swinging gymnastic machine showing a swing operation thereof.

As shown in FIG. 5, in an exercise mode, a person can have his or her calves rested upon the pedals 54 and hands grasping two ends of the handlebar 42.

Thereafter, the person has to exert a force to cause both the handlebar 42 and the pedals 54 to swing both the front swinging assembly 20 and the rear swinging assembly 30 respectively. By using this mode, a user can exercise both the arms and the legs.

It is noted that the damping members 24, 34 and the rings 23, 33 rotate simultaneously as the collars 22, 32 rotate. That is, they co-rotate during the swing. But the washers 25, 35 are fixed during the swing because they are secured to the rods 21, 31 respectively. A strong resistance exists between the damping member 24 and the washer 25 when the threaded fastener 27 is driven to its fastened position and a strong resistance exists between the damping member 34 and the washer 35 when the threaded fastener 37 is driven to its fastened position respectively. Hence, a person has to exert a great force to overcome the resistance through his or her arms and calves in order to exercise. The provision of the spring unit 263 in the concave bottom 262 of the circular cap 26 can cause the washer 25 to urge against the damping member 24 therebelow and the provision of the spring unit 363 in the concave bottom 362 of the circular cap 36 can cause the washer 35 to urge against the damping member 34 therebelow respectively. As a result, a degree of smoothness is carried out in exercise.

Figure 6:
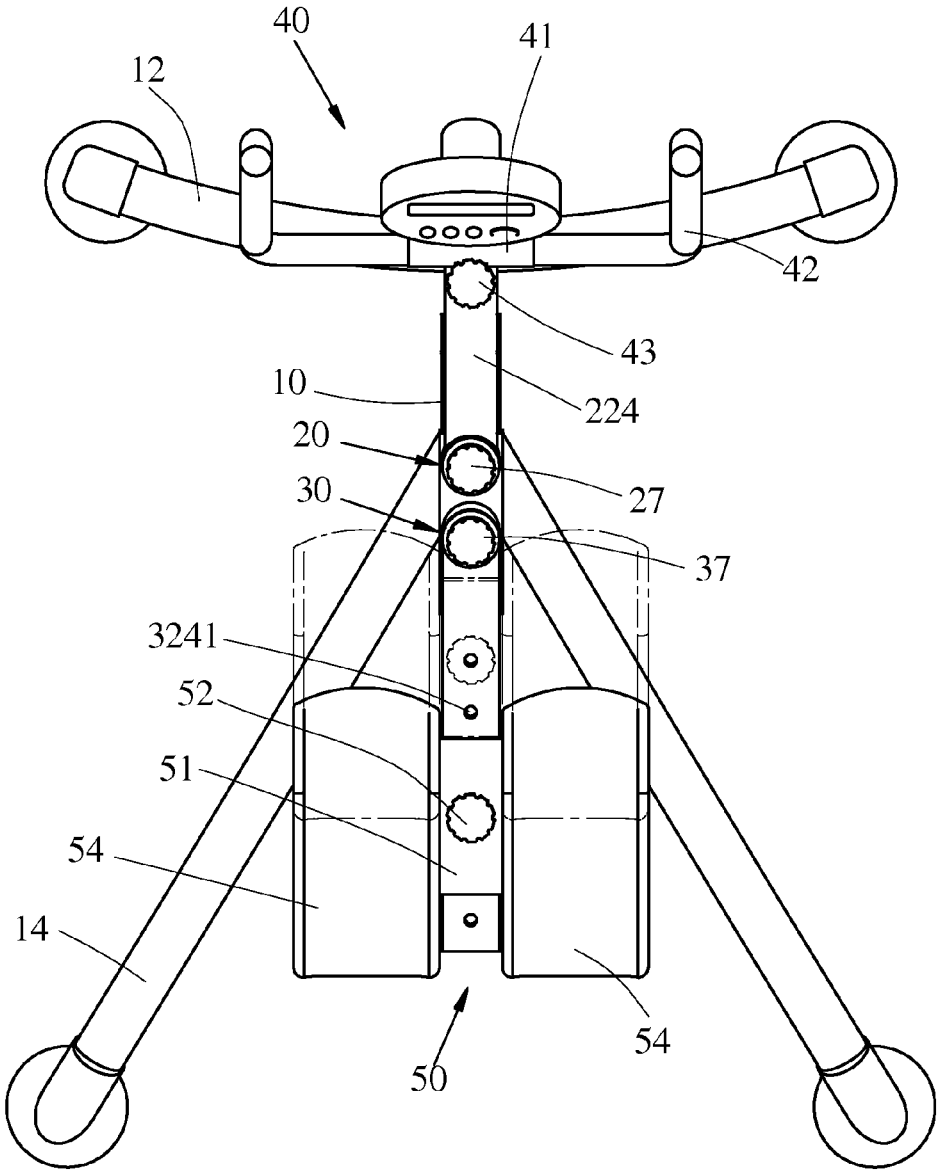
FIG. 6 is a view similar to FIG. 5 showing a location adjustment of the pedals.

As shown in FIGS. 2 and 6, the thumb screw 52 can be driven into any of the apertures 3241 for adjusting a position of the frame member 51. Thus, it can accommodate users of different body heights and proportions.

Figure 7:
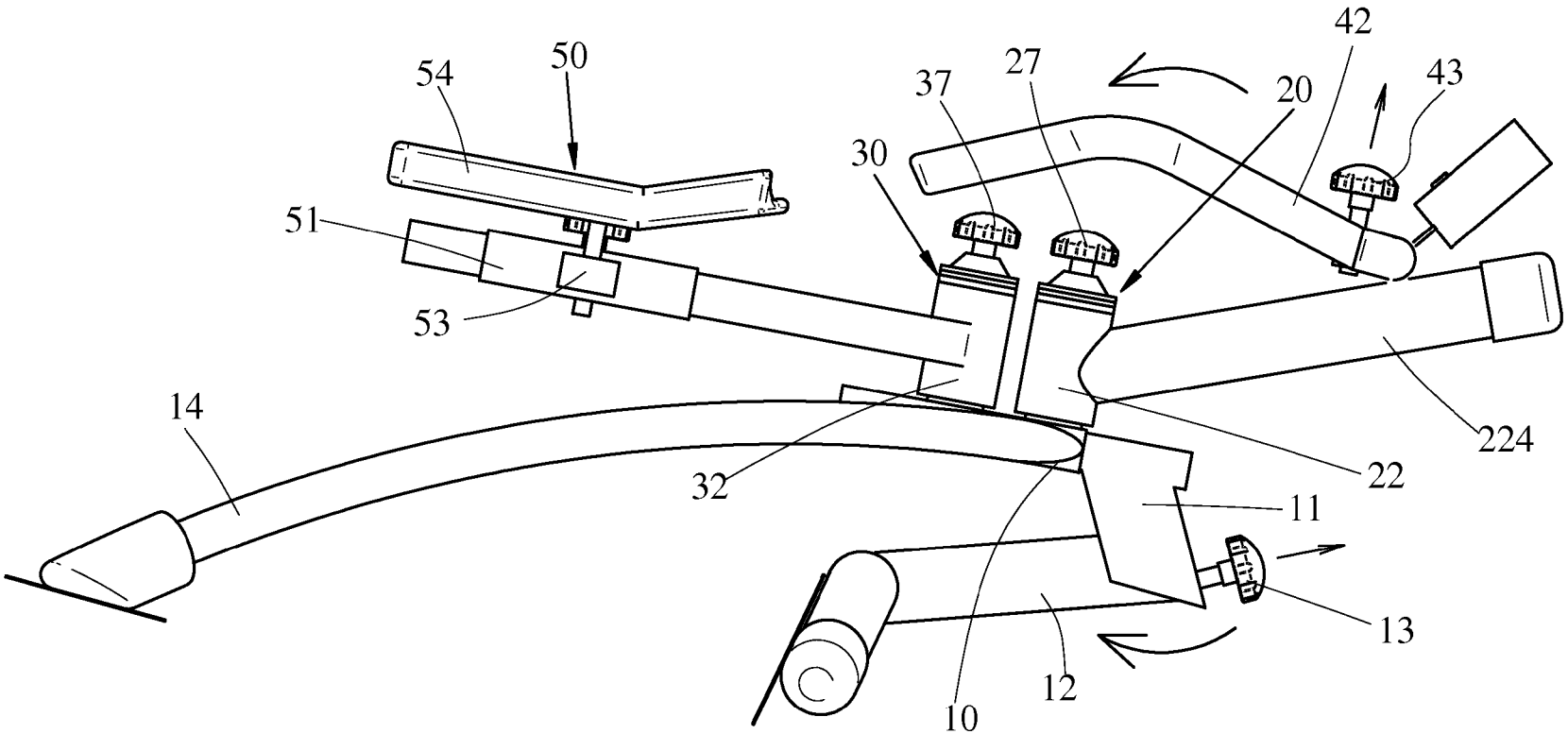
FIG. 7 is a side elevation of the front portion of the swinging gymnastic machine showing a folding operation of the handlebars.

Referring to FIG. 7, loosening of the thumb screw 43 unfastens the handlebar 42. Thereafter, the handlebar 42 can be folded toward the rear end of the base frame 10. Moreover, loosening of the thumb screw 13 can pivot the front leg 12 toward the rear end of the base frame 10. These folding operations have the benefit of reducing the occupied space of the swinging gymnastic machine when it is not in use.

The handle assembly 40 and the pedal assembly 50 of the invention are secured to the collar 22 of the front swinging assembly 20 and the collar 32 of the rear swinging assembly 30 respectively. This arrangement enables these two different swinging assemblies to co-share the weight of an exercising person. Hence, both the rods 21, 31 are unsusceptible of deflection. Frequent parts replacement and maintenance are substantially avoided. Therefore, the swinging gymnastic machine of the invention is more durable and has a prolonged period of use time. This is a great advancement as compared with the prior art.

While the invention herein disclosed has been described by means of specific embodiments, numerous modifications and variations could be made thereto by those skilled in the art without departing from the scope and spirit of the invention set forth in the claims.

What is claimed is:

1. A swinging gymnastic machine comprising:

a base frame comprising a front leg and two rear legs;

a front swinging assembly comprising a front rod fixedly fastened to a front end of the base frame, a front collar rotatably put on the front rod with an upper portion of the front rod being exposed, a front frame element extending from the front collar out of a front end of the base frame; wherein, a front ring fitted in an upper end of the front collar with the front rod passing through, a ring-shaped front damping member disposed on the front ring and being adapted to co-rotate with both the front ring and the front collar, a ring-shaped front washer fixedly put on a top end of the front rod and seated upon the front damping member, a circular front cap comprising a concave bottom and a spring unit disposed in the concave bottom thereof, and a front threaded fastener driven through the circular front cap into the front collar;

a rear swinging assembly comprising a rear rod fixedly fastened to a rear end of the base frame, a rear collar rotatably put on the rear rod with an upper portion of the rear rod being exposed, a rear frame element extending from the rear collar toward the rear end of the base frame; wherein, a rear ring fitted in an upper end of the rear collar with the rear rod passing through, a ring-shaped rear damping member disposed on the rear ring and being adapted to co-rotate with both the rear ring and the rear collar, a ring-shaped rear washer fixedly put on a top end of the rear rod and seated upon the rear damping member, a circular rear cap comprising a concave bottom and a spring unit disposed in the concave bottom thereof, and a rear threaded fastener driven through the circular rear cap into the rear collar;

a handle assembly comprising a handlebar pivotally secured to a front portion of the front frame element; and a pedal assembly slidably put on the rear frame element and comprising one pedal spaced from each side of the rear frame element respectively.

2. The swinging gymnastic machine of claim 1, wherein the base frame further comprises a joint and a leg threaded fastener underneath for releasably pivotally securing the front leg to the joint such that the front leg is adapted to pivot toward the rear end of the base frame in response to loosening the leg threaded fastener.

3. The swinging gymnastic machine of claim 1, wherein the rear legs are splay with the rear end of the base frame disposed therebetween.

4. The swinging gymnastic machine of claim 1, wherein the front swinging assembly comprises:

the front rod with two flat opposites on an opening comprising a threaded hole open to top, and an annular lower flange disposed at a lower portion of the front rod is fixedly fastened to the top of the base frame with the annular lower flange urged against the top of the base frame;

the front collar comprising an axial channel with a major portion of the front rod loosely disposed therein so that the front collar rotates around the front rod, one front recess disposed on each top and bottom end of the channel of the front collar respectively, wherein a diameter of each of the front recesses is greater than that of the channel of the front collar, and one ring-shaped front bearing disposed in each the front recess respectively to be rotatable around the front rod;

the front ring with the front rod passing through and seated upon an upper one of the front bearings, the front ring comprising a plurality of spaced top projections;

the front damping member having an outer diameter equal to that of the front collar and being disposed on the tops of both the front collar and the front ring, the front damping member comprising a central hole and a plurality of spaced bottom cavities with the projections of the front ring matingly inserted therein;

the front washer comprising a central hole having two flat edges, the front washer being put on a top of the front rod to be flush therewith and being seated upon the front damping member;

the circular front cap comprising a central hole aligned with the central hole of the front washer, a concave bottom, and a spring unit disposed in the concave bottom thereof to urge against the front washer therebelow; and the front threaded fastener driven through the central hole of the circular front cap, the central hole of the front washer, and the central hole of the front damping member into the threaded hole of the front rod and seated upon the front damping member.

5. The swinging gymnastic machine of claim 1, wherein the rear swinging assembly comprises:

the rear rod having two flat opposites on an opening comprising a rear threaded hole open to top, and an annular lower flange, wherein a lower portion of the rear rod is fixedly fastened to a top of the base frame with the lower flange urged against the top of the base frame;

the rear collar comprising an axial channel with a major portion of the rear rod loosely disposed therein so that the rear collar rotates around the rear rod, one rear recess on each top and bottom end of the axial channel of the rear collar respectively, wherein a diameter of each of the rear recesses is greater than that of the channel of the rear collar, and one ring-shaped rear bearing disposed in each of the rear recesses respectively to be rotatable around the rear rod;

the rear ring seated upon the rear bearing of the concave bottom with the rear rod passing through, the rear ring comprising a plurality of spaced top projections;

the rear damping member having an outer diameter equal to that of the rear collar and being disposed on the tops of both the rear collar and the rear ring, the rear damping member comprising a central hole and a plurality of spaced bottom cavities with the projections of the rear ring matingly inserted therein;

the rear washer comprising a central hole having two flat edges, the rear washer being put on the rear rod to be flush therewith and being seated upon the rear damping member;

the circular rear cap comprising a central hole aligned with the central hole of the rear washer, the concave bottom, and a spring unit disposed in the concave bottom thereof to urge against the rear washer therebelow; and the rear threaded fastener driven through the central hole of the circular rear cap, the central hole of the rear washer, and the central hole of the rear damping member into the rear threaded hole of the rear rod and seated upon the rear damping member.

6. The swinging gymnastic machine of claim 1, wherein the handle assembly further comprises a C-shaped coupling of having the bottom disposed on the front portion of the front frame element and being rotatably put on a central portion of the handlebar, and the handle threaded fastener driven through two opposite protrusions on a central portion of the C-shaped coupling to secure the handlebar and the coupling together; and loosening of the handle threaded fastener unfastens the handlebar so as to pivot the handlebar toward the rear end of the base frame.

7. The swinging gymnastic machine of claim 1, wherein the rear frame element comprises a plurality of spaced top apertures; and wherein the pedal assembly further comprises a frame member of an inverted U-section slidably put on the rear frame element, and a pedal threaded fastener driven through the frame member into one of the apertures.

8. The swinging gymnastic machine of claim 7, wherein the frame member further comprises an arm extending outwardly from each side of the frame member respectively and each arm comprising a pedal.

* * * * *